United States Patent [19]

Fukuroi

[11] 3,959,858

[45] June 1, 1976

[54] BRIDGE TOP STOP FOR SLIDE FASTENERS

[75] Inventor: Takeo Fukuroi, Uozu, Japan

[73] Assignee: Yoshida Kogyo Kabushiki Kaisha, Japan

[22] Filed: Sept. 2, 1975

[21] Appl. No.: 609,796

[30] Foreign Application Priority Data

Sept. 4, 1974 Japan ..... 49-106333[U]

[52] U.S. Cl. ..... 24/205.11 F; 24/205.11 R

[51] Int. Cl.[2] ..... A44B 19/36

[58] Field of Search ..... 24/205.11 F, 205.11 R, 24/205.1 R

[56] References Cited

UNITED STATES PATENTS

| | | | |
|---|---|---|---|
| 2,784,473 | 3/1957 | Morin | 24/205.11 R |
| 3,869,765 | 3/1975 | Fukuroi | 24/205.11 F |

*Primary Examiner*—Bernard A. Gelak

*Attorney, Agent, or Firm*—Bucknam and Archer

[57] ABSTRACT

A bridge top end stop for slide fasteners which comprises a body mounted astride the stringer tapes and having its rear end wall offset complementarily in shape to a front end face of the slider. There are provided a pair of spaced-apart tongues formed integral with the top stop body and reduced in thickness so that their upper surfaces lie at a level below an upper surface of the body, and a pair of laterally projecting flange-seats formed on the tongues. The tongues are adapted to be inserted into the throats of the slider and between a slider wing and the stringer tapes with the slider diamond interposed between the tongues and with the projecting flange-seats of the tongues engaged with the flanges of the slider.

3 Claims, 3 Drawing Figures

BRIDGE TOP STOP FOR SLIDE FASTENERS

BACKGROUND OF THE INVENTION

This invention relates to slide fasteners and more particularly to an improved bridge top end stop for stopping the movement of a slider at a predetermined point on the top end of the fastener to prevent the slider from running off the fastener elements.

As is well known in the art, the top stop of the type described is anchored in place astride the top ends of a pair of oppositely disposed stringer tapes each carrying on and along its one longitudinal edge a row of interlocking fastener elements, to thereby restrict or terminate the movement of a slider when closing the fastener. Slide fasteners using bridge type top stops are suitable especially for use on bags or pouches because the bridge top stop can prevent the top ends of the stringers from being spread apart when the fastener is closed. Prior to this invention, there were known bridge top end stops having a simple U-shaped or V-shaped contour which, upon abutting engagement with a slider to close the fastener, tends to produce a gap between the slider and the top end stop, with the results that the slider is liable to shifting out of position and furthermore, the gap permits entry of dust and rain into the interior of the bag or pouch to which the fastener is applied.

SUMMARY OF THE INVENTION

With the above-noted prior art drawbacks in view, the present invention has for its principal object to provide an improved bridge top end stop for slide fasteners which when the fastener is closed ensures secure mating engagement with a slider to hold the latter stably in place.

Another object of the invention is to provide an improved bridge top end stop for slide fasteners which incorporates structural features such that will substantially seal the connection between the top end stop and the slider against the intrusion of dust or rain.

Briefly stated, the present invention provides in a slide fastener of the type which comprises a pair of oppositely disposed stringer tapes each carrying along its one longitudinal edge a row of interlocking fastener elemnts and a slider having upper and lower wings which are interconnected by a diamond, and side flanges which project inwardly from either one of the upper and lower wings or both and which together with the diamond form a guide channel including throats for the passage of the fastener elements therethrough, a bridge top end stop which comprises a body mounted astride said stringer tapes and having its rear end wall offset complementarily in shape to a front end face of the slider, a pair of spaced-apart tongues formed integral with said body and reduced in thickness so that their upper surfaces lie at a level below an upper surface of said body, and a pair of laterally projecting flange-seats formed on said tongues, said tongues being adapted to be inserted into said throats of the slider and between said slider wing and said stringer tapes with the diamond interposed between said tongues and with said projecting flangeseats of the tongues engaged with said flanges of the slider.

These and other objects and features of the invention will be more apparent from the following description of a preferred embodiment taken in conjunction with the accompanying drawing wherein like reference numerals denote like parts throughout the several views.

DETAILED DESCRIPTION OF THE PREFERRED EMBODIMENT

Figure 1:
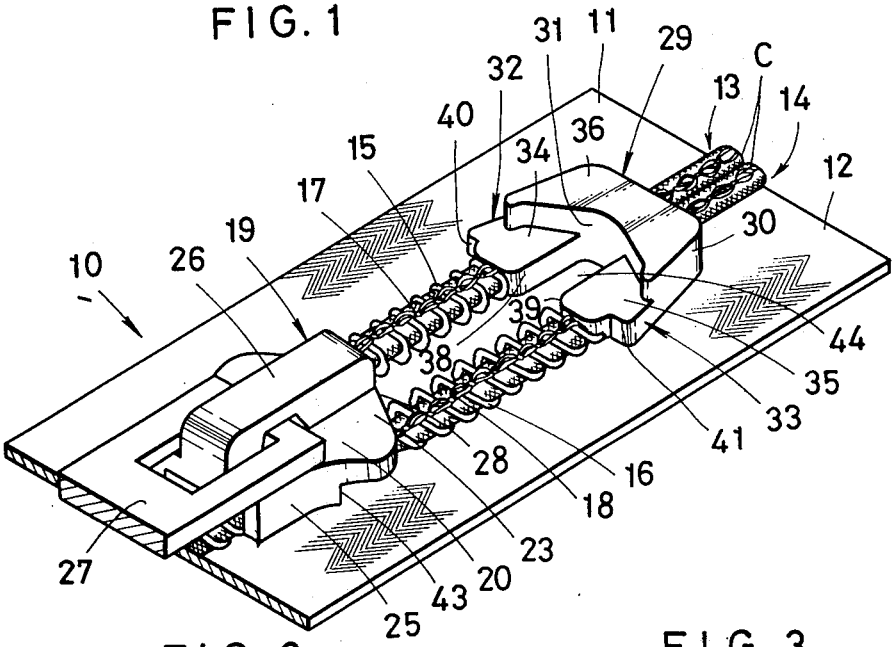
FIG. 1 is a fragmentary perspective view of a slide fastener having an improved bridge top stop embodying the invention.

Referring now to the drawing and FIG. 1 in particular, there is shown a slide fastener 10 of the type which comprises a pair of opposed stringer tapes 11 and 12 carrying on and along their respective longitudinal edges 13 and 14 rows of interlocking fastener elements 15 and 16 formed, in the illustrated embodiment, from a continuous plastics filament and secured to the stringer tapes 11, 12 by sewing stitches 17 and 18, respectively, the sewing stitches passing through filler cords or cores C which extend in and through the fastener element rows 15 and 16. The slide fastener 10 further comprises a slider 19 mounted thereon for reciprocal movement along the longitudinal edges 13, 14 to take the fastener elements 15 and 16 into and out of coupling engagement with one another; namely to close and open the fastener 10 in the well known manner. The slider 19 is of the usual construction consisting generally of spaced-apart upper wing 20 and lower wing 21 (see FIG. 3) connected by a neck or diamond 22 (see FIG. 2), the upper wing 20 having a bulged entrance end 23 and being inwardly bent to form side flanges 24 and 25 which together with the diamond 22 provide a substantially Y-shaped guide channel including throats on opposite sides of the diamond 22 for the passage of the fastener elements 15, 16 therethrough. Mounted on the upper wing 20 is a lug 26 to which a pull tab 27 is pivotally connected. The bulged entrance end 23 of the upper wing 20 has its front end face 28 curved outwardly.

Figure 2:
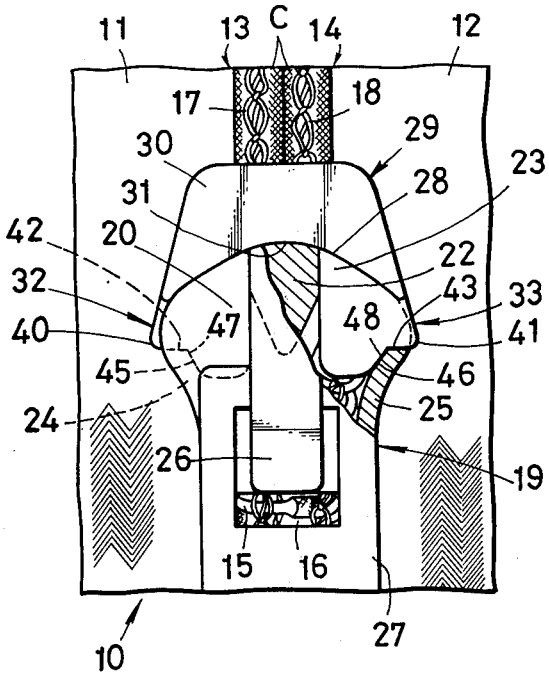
FIG. 2 is a fragmentary plan view, with parts taken away, of the slide fastener of FIG. 1, the fastener being shown as in closed disposition.
Figure 3:
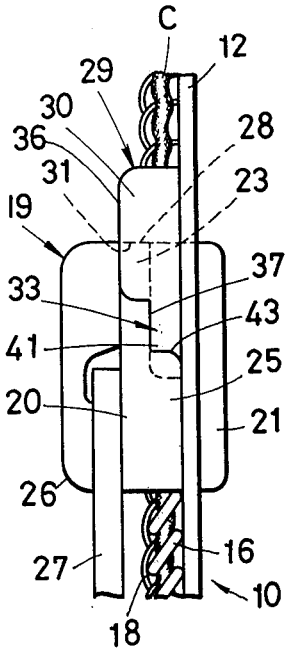
FIG. 3 is a side elevational view of the slide fastener shown in FIG. 2.

According to the invention, there is provided a bridge top end stop generally designated 29 which is engageable in mating relation with the slider 19 to restrict or terminate the movement of the latter at a predetermined point adjacent the top end region of the fastener 10. The bridge top stop 29 comprises a body 30 made of a plastics material and secured as by a molding operation astride the respective stringer tapes 11 and 12 adjacent their beaded edges 13 and 14. The top stop body 30 is provided with an offset rear end wall 31 inwardly curved to conform with the front end face 28 of the slider upper wing 20. There are provided a pair of spaced tongues 32 and 33 formed intergral with and projecting from the rear end wall 31 of the top stop body 30 toward the slider 19. The tongues 32, 33 are secured as by injection-molding directly to the beaded edges 13 and 14 of the respective stringer tapes 11, 12. The tongues 32, 33 are reduced in thickness so that the upper surfaces 34, 35 of the respective tongues 32, 33 lie at a level below the upper surface 36 of the top stop body 30, the thickness of the tongues 32, 33 being substantially equal to the distance between the undersurface 37 of the bulged entrance end 23 of the slider upper wing 20 and the top surface of the stringer tapes 11, 12. The tongues 32 and 33 are provided with respective longitudinal linear edges 38 and 39 extending inwardly of and substantially in parallel with the beaded edges 13, 14 and respective lateraly projecting flange-seats 40 and 41 formed on the tongues 32 and 33 and outwardly of the beaded edges 13 and 14, respectively, and adapted to receive respective flange ends 42 and 43 of the upper wing flanges 24 and 25 of the slider 19 when the latter is brought up to the bridge top stop 29 to close the slide fastener 10. The distance or gap 44 between the longitudinal linear edges 38 and 39 is substantially equal to the width of the diamond 22 of the slider 19, so that the diamond 22 fits tightly between the opposed linear edges 38, 39. A close inspection of FIG. 2 shows that surfaces 45 and 46 contiguous to the respective flange-seats 40 and 41 are configured to conform with the contour of flared inner guide walls 47 and 48, respectively, of the slider 19. The thus constructed bridge top end stop 29 can provide increased area for contact between these two parts of the fastener 10.

With this construction, as the slider 19 is moved up against the bridge top stop 29, closing the opposed stringer tapes 11 and 12 together, the diamond 22 of the slider 19 is inserted between the tongues 32 and 33, until the front end face 28 of the upper wing 23 abuts against and is held in intimate contact with the rear end wall 31 of the top stop body 30. In this instance, the tongues 32 and 33 are inserted in the respective throats of the slider 19; that is, between the slider upper wing 20 and the stringer tapes 11, 12, whereupon the projecting flange-seats 40 and 41 mate with the respective flange ends 42 and 43 of the slider 19. Accordingly, after the fastener 10 is completely closed, the slider 19 can be retained in close abutting and stopping engagement with the bridge top stop 29 substantially in sealing relation with each other, forming a substatially liquid-tight junction between the two fastener components to prohibit entry of rain or other foreign matters into the interior of the article to which the fastener is attached. Another advantage resulting from this structure is that there is provided a three-dimensional face-to-face connection between the bridge top stop 29 and the slider 19 as above described which retains the slider stably in place against displacement which would otherwise occur under severe external stresses.

What is claimed is:

1. In a slide fastener of the type which comprises a pair of oppositely disposed stringer tapes each carrying along its one longitudinal edge a row of interlocking fastener elements and a slider having upper and lower wings which are inter-connected by a diamond, and side flanges which project inwardly from either one of the upper and lower wings or both and which together with the diamond form a guide channel including throats for the passage of the fastener elements therethrough, a bridge top end stop which comprises a body mounted astride said stringer tapes and having its rear end wall offset complementarily in shape to a front end face of the slider, a pair of spaced-apart tongues formed integral with said body and reduced in thickness so that their upper surfaces lie at a level below an upper surface of said body, and a pair of laterally projecting flange-seats formed on said tongues, said tongues being adapted to be inserted into said throats of the slider and between said slider wing and said stringer tapes with the diamond interposed between said tongues and with said projecting flange-seats of the tongues engaged with said flanges of the slider.

2. A bridge top end stop as defined in claim 1 wherein said offset rear end wall has an inwardly curved contour to conform with an outwardly curved front end face of the slider.

3. A bridge top end stop as defined in claim 1 wherein the thickness of said tongues is substantially equal to the distance between said wing and a surface of the stringer tapes.

* * * * *